US011158471B2

(12) United States Patent
Namikawa et al.

(10) Patent No.: US 11,158,471 B2
(45) Date of Patent: Oct. 26, 2021

(54) HOUSING OF ELECTRONIC DEVICE, METHOD OF MANUFACTURING HOUSING OF ELECTRONIC DEVICE, AND BREAKER HAVING THE SAME

(71) Applicants: BOURNS KK, Osaka (JP); POLYPLASTICS CO., LTD., Tokyo (JP)

(72) Inventors: Masashi Namikawa, Osaka (JP); Shinichi Hirota, Shizuoka (JP)

(73) Assignees: BOURNS KK, Osaka (JP); POLYPLASTICS CO., LTD., Tokyo (JP)

( * ) Notice: Subject to any disclaimer, the term of this patent is extended or adjusted under 35 U.S.C. 154(b) by 816 days.

(21) Appl. No.: 15/777,594

(22) PCT Filed: Nov. 21, 2016

(86) PCT No.: PCT/JP2016/084447
§ 371 (c)(1),
(2) Date: May 18, 2018

(87) PCT Pub. No.: WO2017/086486
PCT Pub. Date: May 26, 2017

(65) Prior Publication Data

US 2021/0210297 A1 Jul. 8, 2021

(30) Foreign Application Priority Data

Nov. 20, 2015 (JP) ..... JP2015-227931

(51) Int. Cl.
*H01H 37/04* (2006.01)
*H01H 37/64* (2006.01)
*H01H 11/00* (2006.01)

(52) U.S. Cl.
CPC ..... *H01H 37/04* (2013.01); *H01H 11/00* (2013.01); *H01H 37/64* (2013.01)

(58) Field of Classification Search
CPC ..... H01H 37/04; H01H 37/64; H01H 11/00
See application file for complete search history.

(56) References Cited

U.S. PATENT DOCUMENTS 6,396,381 B1 * 5/2002 Takeda ..... H01H 1/504 337/342
9,159,985 B2 * 10/2015 Nakanishi ..... H01H 37/14
(Continued)

FOREIGN PATENT DOCUMENTS

CN 102245709 11/2011
JP 2013-201123 10/2013
(Continued)

OTHER PUBLICATIONS

International Search Report for corresponding App. No. PCT/JP2016/084447, dated Feb. 28, 2017.

*Primary Examiner* — Stephen S Sul
(74) *Attorney, Agent, or Firm* — Renner, Otto, Boisselle & Sklar, LLP

(57) ABSTRACT

Provided is a breaker capable of further downsizing without impairing rigidity and strength of a case. The breaker 1 comprises a fixed contact 21, a movable piece 4 having and pressing a movable contact 41 to the fixed contact 21, a thermally responsive element 5 for moving the movable piece 4 to separate the movable contact 41 from the fixed contact 21 by deformation thereof responding to temperature change, a case for containing the fixed piece 21, the movable piece 4 and the thermally responsive element 5, and a cover piece 8 attached on the case 7. The case 7 has an end face 72 on which the cover piece 8 is disposed, a containing recess 73 caved from the end face 72 and forming a space to which the movable piece 4 and the thermally responsive
(Continued)

element 5 are contained, and a first protrusion protruding from the end face 72 and to which the cover piece 8 is fitted.

8 Claims, 13 Drawing Sheets

(56) References Cited

U.S. PATENT DOCUMENTS

| | | | | |
|---|---|---|---|---|
| 2001/0050609 | A1* | 12/2001 | Takeda | H01H 37/5427 337/333 |
| 2002/0060898 | A1* | 5/2002 | Nagai | H01H 37/54 361/634 |
| 2013/0323547 | A1* | 12/2013 | Namikawa | H01H 37/5427 429/61 |
| 2014/0334055 | A1* | 11/2014 | Namikawa | H01H 37/04 361/115 |

FOREIGN PATENT DOCUMENTS

| | | |
|---|---|---|
| JP | 5452771 | 1/2014 |
| JP | 2014006994 | 1/2014 |
| JP | 2015040248 | 3/2015 |

* cited by examiner

HOUSING OF ELECTRONIC DEVICE, METHOD OF MANUFACTURING HOUSING OF ELECTRONIC DEVICE, AND BREAKER HAVING THE SAME

TECHNICAL FIELD

The present invention relates to a housing of electronic device, a method of manufacturing a housing of electronic device, and a breaker having the same.

BACKGROUND ART

As for an example of an apparatus configured of a housing of electronic device having a case containing electronic elements, a breaker is employed as a protection device (safety circuit) of a secondary battery, an electric motor, or the like. The breaker cuts off electric current in order to protect the secondary battery or the electric motor when the temperature of the secondary battery during charging or discharging excessively rises, or when an abnormality such as an overcurrent flowing to the motor or the like equipped in equipment such as an automobile or a home electric appliance or the like occurs. In order to ensure the safety of the equipment, the breaker used as such a protection device is required to operate accurately following the temperature change (having favorable temperature characteristics) and to be stabilized the resistance value when it is energized.

The breaker is provided with a thermally responsive element which operates responding to the temperature change and conducts or cuts off the electric current. In Patent Literature 1, a breaker using a bimetal as a thermally responsive element is disclosed. The bimetal is formed by laminating platy pieces made of two kinds of metal materials having different coefficients of thermal expansion, and controls conductive/nonconductive state of the contacts by deforming the shape of the laminated plate-like pieces responding to temperature change due to the difference in the thermal expansion coefficients. In the breaker disclosed in the Literature, elements such as a fixed piece, a movable piece, a thermally responsive element, a PTC thermistor and so on are housed in a case, and the terminals of the fixed piece and the movable piece are respectively connected to electric circuits of electric equipment when it is used.

CITATION LIST

Patent Literature

[PTL 1] Japanese Patent No. 5452771

SUMMARY OF INVENTION

Technical Problems

In the breaker disclosed in Patent Literature 1, the rigidity and strength of the case are enhanced by insert molding the cover piece made of phosphor bronze as a main component to a lid member constituting a part of the case. The lid member is formed of a resin and is disposed on both front and back surfaces of the cover piece. With such a structure, since the total thickness of the lid members including the cover piece increases, it is difficult to downsize (making low profile) of the breaker. In particular, since the thickness of the central region of the breaker which overlaps with the thermally responsive element in a plan view is large, the degree of freedom in mounting on electrical equipment has been limited.

The present invention is conceived to solve the above-described problems, and an object of the present invention is to provide a housing of electronic device, a method of manufacturing a housing of electronic device, and a method of manufacturing a breaker having the same, which enable to further downsize the housing without impairing the rigidity and strength thereof.

Solution of Problems

In order to achieve the above object, a housing of electronic device according to the present invention comprises a case for containing electronic elements therein and a cover piece attached to the case, wherein the case has an end face on which the cover piece is disposed, a containing recess which is caved from the end face and serves as a space into which the electronic elements are contained, and a first protrusion which is protruded from the end face and to which the cover piece is fitted, and the case is formed of a thermoplastic resin composition having heat deflection temperature under load in a range equal to or higher than 120 degrees Celsius and equal to or lower than 320 degrees Celsius, and temperature difference between melting point and the heat deflection temperature under load is equal to or larger than 15 degrees Celsius.

It may be configured that the cover piece has an outer surface exposed from the case and the first protrusion is formed to protrude from the outer surface.

It may be configured that the case has outer lateral faces intersecting with the end face or extension of the end face and the first protrusion is disposed inside the case more than the outer lateral faces.

It may be configured that the case has a second protrusion protruding from the first protrusion toward the inside of the case and engaging with the outer surface.

It may be configured that a tip end of the first protrusion is protruded further away from the end face than the second protrusion.

It may be configured that the first protrusion is continuously formed seamlessly over whole circumference of the cover piece.

It may be configured that the second protrusion is continuously formed seamlessly over whole circumference of the cover piece.

It may be configured that the case further has a third protrusion protruding from the first protrusion toward the outside of the case.

A method for manufacturing a housing of electronic device according to any one of the above includes: a first step for containing at least the electronic elements into the containing recess; a second step for attaching the cover piece to the end face; a third step for pressing the first protrusion toward the end face; and a fourth step for deforming the first protrusion by heating at least one of the first protrusion and the cover piece.

A breaker according to the present invention is characterized in that a fixed piece having a fixed contact, a movable piece having a movable contact and pressing and contacting the movable contact to the fixed contact, and a thermally responsive element for moving the movable piece to separate the movable contact from the fixed contact by deformation thereof responding to temperature change are contained in any one of the above housings of electronic device as the electronic elements.

Advantageous Effects of Invention

The housing of electronic device according to the present invention comprises the case into which the electronic elements such as the fixed contact, the movable piece, the thermally responsive element and so on and the cover piece attached to the case, for example. Since the cover piece is disposed directly on the end face of the case, the thickness of the housing of electronic device is suppressed, it is possible to downsize the breaker using the housing of electronic device, for example, and thus, degree of freedom in mounting on the electric device can be increased. In addition, the cover piece is fitted to the first protrusion protruding from the end face. Consequently, the cover piece and the first protrusion are firmly joined, and sufficient rigidity and strength are obtained by the case and the cover piece.

DESCRIPTION OF INVENTION

Figure 1:
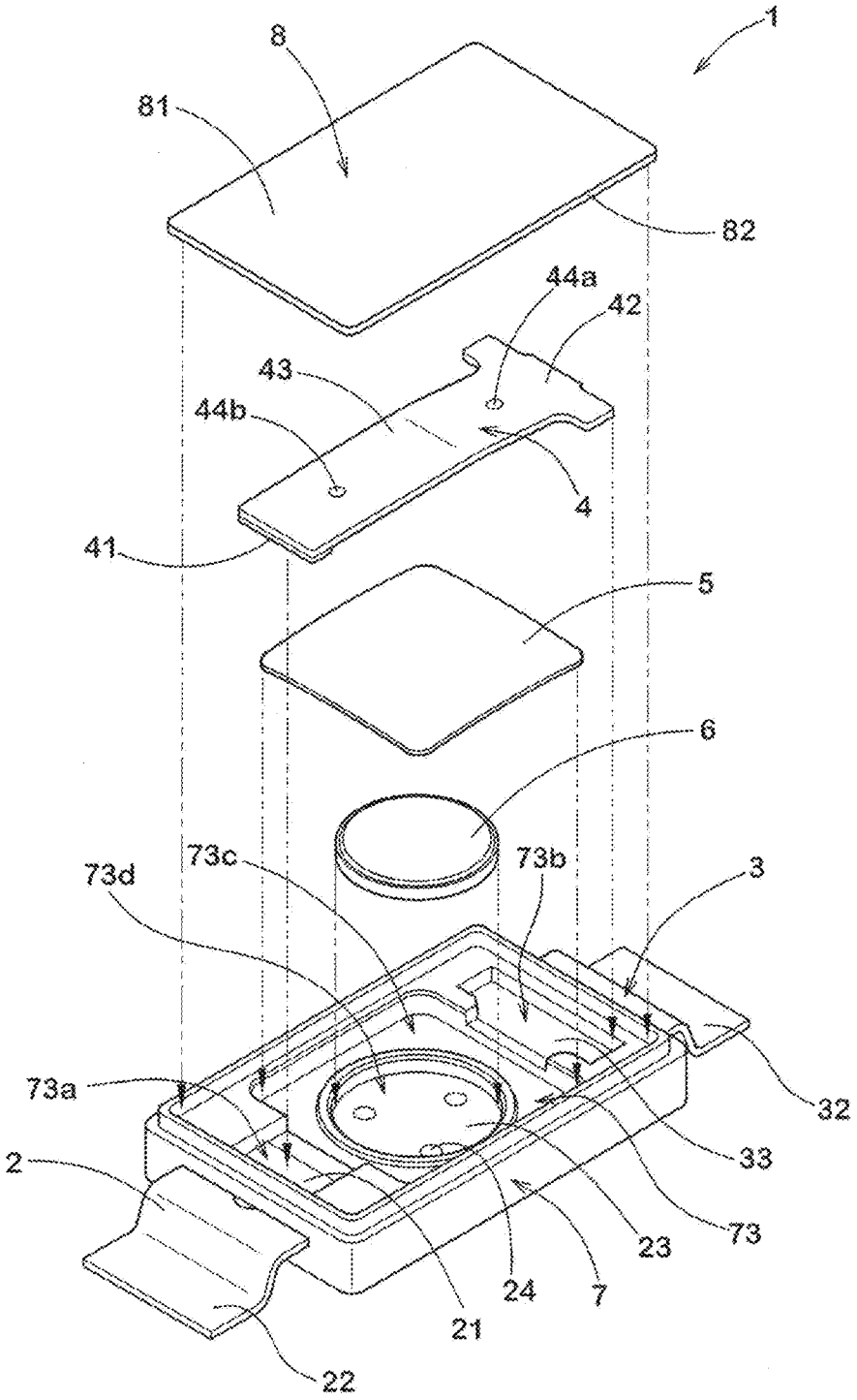
FIG. 1 is an exploded perspective view showing a schematic configuration of a breaker having a housing of electronic device according to an embodiment of the present invention.
Figure 2:
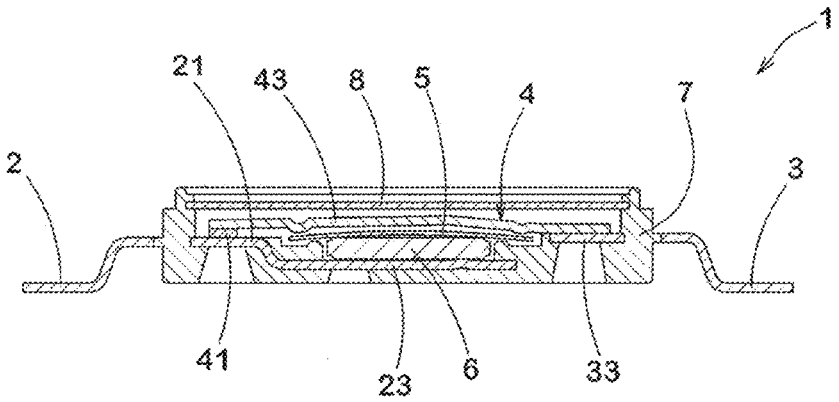
FIG. 2 is a cross-sectional view showing the breaker in a normal charging or discharging state.
Figure 3:
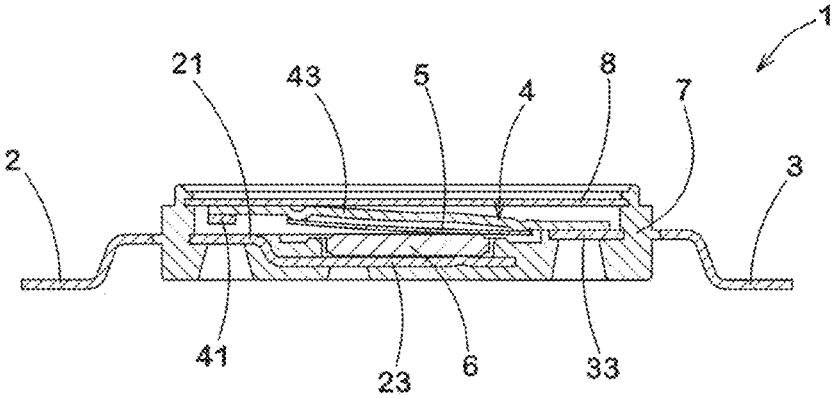
FIG. 3 is a cross-sectional view showing the breaker in an overcharged state or in an abnormal state.

A housing of electronic device, a method of manufacturing a housing of electronic device, and a breaker having the same according to an embodiment of the present invention will be described with reference to the drawings. FIGS. 1 to 3 show a configuration of a breaker having a housing of electronic device according to the present embodiment. The breaker 1 is configured of a fixed piece 2 having a fixed contact 21, a terminal piece 3 on which a terminal is formed, a movable piece 4 having a movable contact 41 at a front end thereof, a thermally responsive element 5 which deforms responding to temperature change, a PTC (Positive Temperature Coefficient) thermistor 6, a case 7 containing the fixed piece 2, the terminal piece 3, the movable piece 4, the thermally responsive element 5 and the PTC thermistor 6, a cover piece 8 attached to the case 7, and so on.

The fixed piece 2 is formed by press working a metal plate containing copper or the like as a main component (a metal plate such as copper-titanium alloy, nickel silver, brass or the like, other than this), and embedded in the case 7 by insert molding. A terminal 22 that is electrically connected to an external circuit is formed at an end of the fixed piece 2 and a support portion 23 that supports the PTC thermistor 6 is formed at the other end side. The PTC thermistor 6 is placed on three convex protrusions (dowels) 24 formed on the support portion 23 of the fixed piece 2, and is supported by the protrusions 24.

The fixed contact 21 is formed at a position opposing to the movable contact 41 by cladding, plating, coating, or the like of a material having high conductivity such as a copper-silver alloy, a gold-silver alloy, etc. in addition to silver, nickel and nickel-silver alloy, and is exposed from a part of the opening 73*a* formed inside the case 7. The terminal 22 protrudes outward from an end edge of the case 7. The support portion 23 is exposed from an opening 73*d* formed inside the case 7.

In the description of the present invention, unless otherwise specified, it is explained that the surface of the fixed piece 2 on the side where the fixed contact 21 is formed (that is, the upper surface in FIG. 1) is referred to the front surface (front), and the opposite side is referred to the back surface (back). The same applies to other elements such as the movable piece 4, the thermally responsive element 5 and so on.

Similar to the fixed piece 2, the terminal piece 3 is formed by press working a metal plate containing copper or the like as a main component, and is embedded in the case 7 by insert molding. A terminal 32 that is electrically connected to the external circuit is formed at an end of the terminal piece 3 and a connecting portion 33 that is electrically connected to the movable piece 4 is formed on the other end side. The terminal 32 is protruded outward from the edge of the case 7. The connecting portion 33 is exposed from an opening 73*b* provided inside the case 7 and is electrically connected to the movable piece 4.

The movable piece 4 is formed in an arm shape which is symmetrical with respect to the center line in the longitudinal direction by press working a plate-shaped metal material. As for the material of the movable piece 4, it is preferable to use copper or the like as a main component which is equivalent to that of the fixing piece 2. Other than this, a conductive elastic material such as copper-titanium alloy, nickel silver, brass or the like may be used.

The movable contact 41 is formed at the front end portion of the movable piece 4. The movable contact 41 is formed of a material equivalent to that of the fixed contact 21 and joined to the front end portion of the movable piece 4 by a technique such as cladding, crimping or the like in addition to welding.

A connecting portion 42 that is electrically connected to the connecting portion 33 of the terminal piece 3 is formed at the front (SIC: rear) end portion of the movable piece 4. The connecting portion 33 of the terminal piece 3 and the connecting portion 42 of the movable piece 4 are fixed by welding, for example.

The movable piece 4 has an elastic portion 43 between the movable contact 41 and the connecting portion 42. The elastic portion 43 is extended from the connecting portion 42 toward the movable contact 41. The movable piece 4 is fixed by being adhered to the connecting portion 33 of the terminal piece 3 at the connecting portion 42, the elastic portion 43 is elastically deformed so that the movable contact 41 formed at the front end thereof is pressed toward and contacted with the fixed contact 21, and thus, the fixed piece 2 and the movable piece 4 can be energized. Since the movable piece 4 and the terminal piece 3 are electrically connected, the fixed piece 2 and the terminal piece 3 can be energized.

The movable piece 4 is curved or bent by press working in the elastic portion 43. The degree of curve or bend is not particularly limited as long as it can contain the thermally responsive element 5, and may be appropriately set in consideration of the elastic force, the pressing force of the contact and so on at the operating temperature and returning temperature. In addition, a pair of protrusions (contact portions) 44*a* and 44*b* are formed on the back surface of the elastic portion 43 so as to face the thermally responsive element 5. The protrusions 44*a* and 44*b* are brought into contact with the thermally responsive element 5, so that the deformation of the thermally responsive element 5 is transmitted to the elastic portion 43 via the protrusions 44*a* and 44*b* (see FIGS. 1, 2 and 3).

The thermally responsive element 5 has an initial shape curved in an arc shape and is formed by laminating thin plate materials having different coefficients of thermal expansion. When it reaches to the operation temperature by overheating, the curved shape of the thermally responsive element 5 warps backward with snap motion and restores when it falls below the return temperature by cooling. The initial shape of the thermally responsive element 5 can be formed by press work. As long as the elastic portion 43 of the movable piece 4 is pushed up by the reverse warping operation of the thermally responsive element 5 at the desired temperature and returned to its original state by the elastic force of the elastic portion 43, the materials and shape of the thermally responsive element 5 are not particularly limited. However, from the viewpoint of productivity and efficiency of reverse warping operation, a rectangle is desirable, and in order to push up the elastic portion 43 efficiently despite its small size, it is desirable to be a rectangle close to a square shape. Besides, as for the materials of the thermally responsive element 5, a laminate of two kinds of materials having different coefficients of thermal expansion consists of copper-nickel-manganese alloy or nickel-chromium-iron alloy on the high expansion side, and various alloys such as nickel silver, brass, stainless steel, and so on starting with iron-nickel alloy on the low expansion side, are used in combination corresponding to the required conditions, for example.

The PTC thermistor 6 is disposed between the fixed piece 2 and the thermally responsive element 5. More specifically, the fixed piece 2 is positioned just below the thermally responsive element 5 with the PTC thermistor 6 interposed therebetween. When the energization between the fixed piece 2 and the movable piece 4 is interrupted by the reverse warping operation of the thermally responsive element 5, an electric current flowing through the PTC thermistor 6 is increased. In the case where the PTC thermistor 6 has a positive characteristic that limits electric current by increasing the value of resistance with increase in temperature, it can be selected among various kinds of thermistors corresponding to requirement such as operating current, operating voltage, operating temperature, restoring temperature, and so on, and the materials and the shape of it are not particularly limited as long as they do not impair these various properties. In the present embodiment, a ceramic sintered body containing barium titanate, strontium titanate or calcium titanate is used. In addition to the ceramic sintered body, a so-called polymer PTC in which conductive particles such as carbon or the like is contained in the polymer may be used.

As for the material constituting the case 7, a thermoplastic resin composition having heat deflection temperature under load in a range equal to or higher than 120 degrees Celsius and equal to or lower than 320 degrees Celsius, and temperature difference between melting point and the heat deflection temperature under load is equal to or larger than 15 degrees Celsius is used for molding. As for the resin used for the thermoplastic resin composition, a thermoplastic resin such as a polyamide having flame retardance, a polyphenylene sulfide (PPS) excellent in heat resistance, a liquid crystal polymer (LCP), a polybutylene terephthalate (PBT), or the like is preferable. Hereupon, in the case where heat resistance is required, such as being used for applications where the housing of electronic device is exposed to high temperatures, it is preferable that the heat deflection temperature under load of the thermoplastic resin composition is equal to or higher than 200 degrees Celsius. In view of suppressing discoloration of the cover piece in the process of fixing the cover piece by deforming the first protrusion of the case, it is preferable that the heat deflection temperature under load is equal to or lower than 300 degrees Celsius. In addition, in view of making it easy to deform the first protrusion only while suppressing the entire deformation of the case, it is preferable that the difference between the melting point and the heat deflection temperature under load is equal to or larger than 50 degrees Celsius. On the other hand, in the case where it is required the particularly high heat resistance such as in the case where the housing of electronic device is subjected to a lead-free reflow soldering process, it is preferable that both the melting point and the heat deflection temperature under load are equal to or higher than 300 degrees Celsius. The melting point and the heat deflection temperature under load of the thermoplastic resin composition can be appropriately adjusted depending on the type of the resin to be used and the type and amount of the filler. Beyond that, in order to impart properties required depending on the use, a commonly used additive agent such as a flame retardant, a flame retardant aid, an antioxidant, a stabilizer, a plasticizer, a nucleating agent, a lubricant, a mold release agent, or the like may be added to a thermoplastic resin composition. In addition, in the case of using a thermoplastic resin composition having a high heat deflection temperature under load, it is preferable to add a coloring agent (carbon black or the like) that absorbs laser beams, and to irradiate laser beams to reach to the first protrusion in a fourth step which will be described later, so that heating of the first protrusion by the laser beams is promoted, and thus, it is easy to deform the first protrusion even under a heating condition that does not discolor the cover piece. Materials other than resin may be applied as long as characteristics equal to or higher than those of the above-described resins can be obtained.

A containing recess 73 is formed in the case 7 to contain the movable piece 4, the thermally responsive element 5, the PTC thermistor 6 and so on. The containing recess 73 has openings 73*a* and 73*b* for containing the movable piece 4, an opening 73*c* for containing the movable piece 4 and the thermally responsive element 5, an opening 73*d* for containing the PTC thermistor 6, and so on. In addition, edges of the movable piece 4 and the thermally responsive element 5 built in the case 7 are respectively brought into contact with a frame formed inside the containing recess 73, and are guided in the reverse warping of the thermally responsive element 5.

The cover piece 8 is formed by press working a metal plate containing copper or the like as a main component or a metal plate such as stainless steel. The cover piece 8 is formed in a rectangular flat plate shape and has an outer surface 81 and an end edge 82. The outer surface 81 is formed on a front surface side of the cover piece 8. The end edge 82 is formed on the periphery of the cover piece 8. As shown in FIGS. 2 and 3, the cover piece 8 is brought into contact with the front surface of the movable piece 4 arbitrarily so as to regulate the movement of the movable piece 4, and contributes downsizing of the breaker 1 while increasing the rigidity and strength of the case 7 as the housing.

As shown in FIG. 1, the cover piece 8 is attached to the case 7 so as to cover the openings 73*a*, 73*b*, 73*c*, and so on of the case 7 into which the fixed piece 2, the movable piece 4, the thermally responsive element 5, the PTC thermistor 6, and so on are contained.

FIG. 2 shows the operation of the breaker 1 in a normal charging or discharging state. In the normal charging or discharging state, the thermally responsive element 5 maintains the initial shape (before the reverse warping), the fixed contact 21 and the movable contact 41 are in contact with each other, and the both terminals 22 and 32 of the breaker 1 is conducted via the elastic portion 43 of the movable contact 4. The elastic portion 43 of the movable piece 4 and the thermally responsive element 5 are in contact with each other, and the movable piece 4, the thermally responsive element 5, the PTC thermistor 6 and the fixed piece 2 are conducting as a circuit. However, since the resistance of the PTC thermistor 6 is overwhelmingly larger than the resistance of the movable piece 4, the current flowing through the PTC thermistor 6 is a substantially negligible level in comparison with the amount of that flowing through the fixed contact 21 and the movable contact 41.

FIG. 3 shows the operation of the breaker 1 in an overcharged state or in an abnormal condition. When it reaches to a high temperature state due to overcharging or abnormality, the thermally responsive element 5 which has reached the operating temperature warps in reverse, so that the elastic portion 43 of the movable piece 4 is pushed up and the fixed contact 21 and the movable contact 41 are separated. At this time, the current flowing between the fixed contact 21 and the movable contact 41 is interrupted, and a slight leakage current flows through the thermally responsive element 5 and the PTC thermistor 6. The PTC thermistor 6 continues to generate heat as long as such a leakage current flows and drastically increases the resistance value while maintaining the thermally responsive element 5 in the reverse warped state, so that no current flows through the path between the fixed contact 21 and the movable contact 41, and only the slight leakage current described above exists (constitutes a self-holding circuit). This leakage current can be used for other functions of the safety device.

When the overcharged state is canceled or the abnormal state is eliminated, the heat generation of the PTC thermistor 6 also terminated, and the thermally responsive element 5 returns to the return temperature to restore the original initial shape. Then, the movable contact 41 and the fixed contact 21 come into contact with each other again by the elastic force of the elastic portion 43 of the movable piece 4, the circuit is released from the cut-off state and returns to the conductive state shown in FIG. 2.

Figure 4:
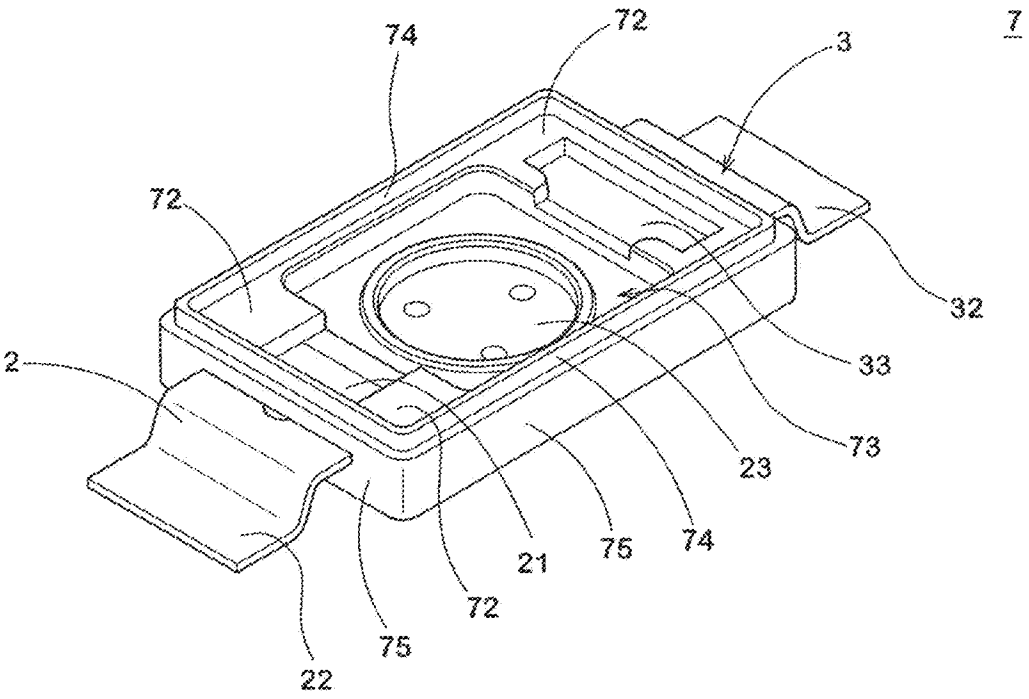
FIG. 4 is a perspective view showing a configuration of a case of the housing of electronic device or a breaker having the housing of electronic device.
Figure 5:
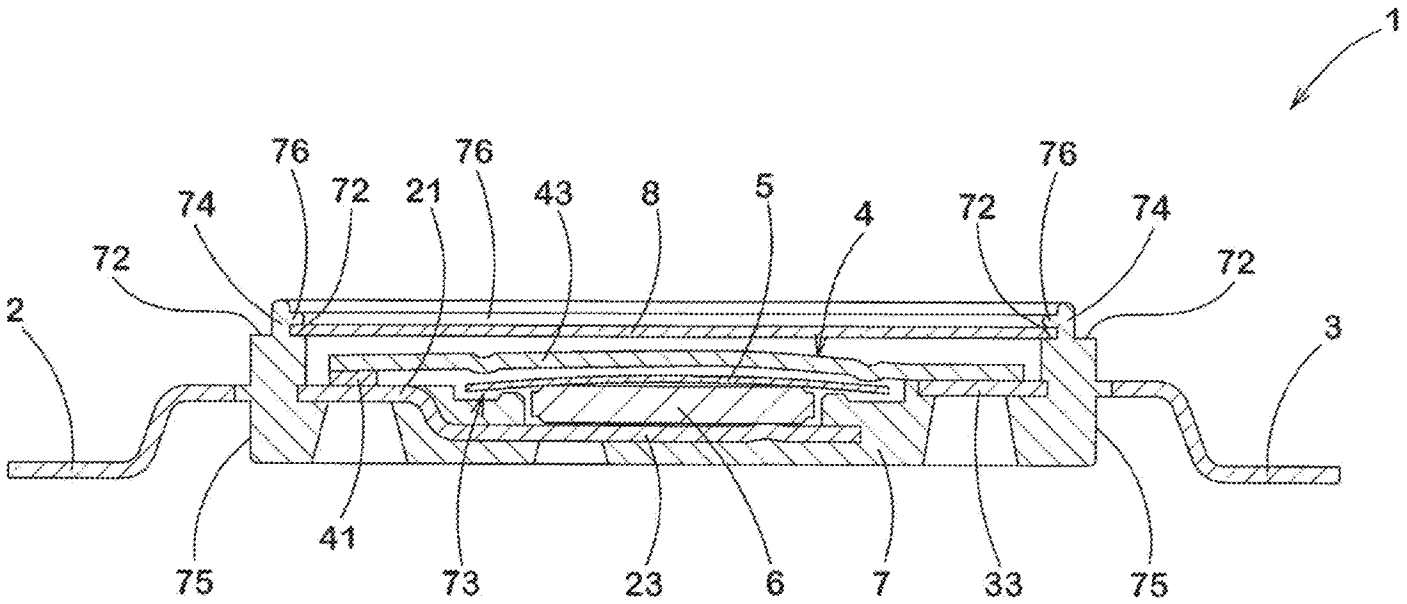
FIG. 5 is a sectional view showing a configuration of a completed breaker.

FIG. 4 shows the case 7. In addition, FIG. 5 shows the configuration of the completed breaker 1. The case 7 has an end face 72 on which the cover piece 8 is disposed, the containing recess 73 for containing the movable piece 4 and the thermally responsive element 5, and the first protrusion 74 to which the end edge 82 of the cover piece 8 is fitted.

The end face 72 is formed in a shape corresponding to the back face of the cover piece 8. The end face 72 of the present embodiment is formed in a planar shape so as to correspond to a plane that is the shape of the back face of the cover piece 8, for example.

The containing recess 73 is caved from the end face 72 and forms a space for containing the movable piece 4 and the thermally responsive element 5.

The first protrusion 74 is formed so as to protrude from the end face 72. In the present embodiment, the first protrusion 74 rises vertically from the end face 72. The first protrusion 74 fits into the end edge 82 of the cover piece 8 and fixes the cover piece 8 on the end face 72 by crimping.

As shown in FIG. 5, since the cover piece 8 is directly disposed on the end face 72 of the case 7, the thickness of the breaker 1 is suppressed, the breaker 1 can be downsized, and degree of freedom in mounting on electronic equipment and so on is enhanced. In addition, the cover piece 8 is fitted to and crimped by the first protrusion 74 protruding from the end face 72. Consequently, the cover piece 8 and the first protrusion 74 are firmly joined, and sufficient rigidity and strength are obtained by the case 7 and the cover piece 8.

When the cover piece 8 is attached to the case 7, most of the outer surface 81 is exposed from the case 7. Thereby, it possible to make the breaker 1 low profile particularly in the central region of the breaker 1 overlapping with the thermally responsive element 5 in planar view. In addition, the first protrusion 74 is formed to protrude from the outer surface 81. Consequently, even if a conductor approaches above the breaker 1 due to some circumstances and the risk of short-circuiting arises, the first protrusion 74 positioned between the outer surface 81 of the cover piece 8 and the terminal 22 of the fixed piece 2 and the terminal 32 of the terminal piece 3 serves as a wall to block the conductor. Therefore, short-circuit between the cover piece 8 and the fixed piece 2 and/or the terminal piece 3 is effectively suppressed by the first protrusion 74 protruding from the outer surface 81.

The case 7 has two pairs of outer side faces 75 which intersect with the end face 72 or the extension face of the end face 72. Each pair of the outer side surfaces 75 are formed in a planar shape and are arranged to face each other in the longitudinal direction or in the lateral direction of the case 7. The fixed piece 2 and the terminal piece 3 protrude from the outer side surfaces 75 arranged to face each other in the longitudinal direction of the case 7 and are exposed from the case 7.

Each outer side surface 75 is used for positioning when the breaker 1 is mounted on electric equipment. When downsizing of the breaker 1 is made progress, the planar outer surface 75 is suitable as a positioning means. In the present embodiment, the end face 72 extends to a region outside the first protrusion 74 and is orthogonal to the outer sides 75. Accordingly, the first protrusion 74 is arranged inside the case 7 more than the outer side surfaces 75. The end face 72 may be formed only in a region inside the first protrusion 74. In such a case, the outer side surfaces of the first protrusion 74 and the outer side surfaces 75 of the case 7 may be provided on the same planes.

As described above, in the configuration having crimping of the cover piece 8 by deformation of the first protrusion 74, stress occurs in the first protrusion 74, and the first protrusion 74 enlarges outward slightly. Therefore, in the breaker configured to include the first protrusion 74 as a positioning means for mounting on electric equipment, if the first protrusion 74 enlarged outside the case 7 than the outside surface 75, it may affect the positioning accuracy of the breaker.

However, in the present embodiment, since the first protrusion 74 is disposed inside the case 7 more than the outer side surface 75, in the case of applying the outer side surface 75 as a positioning means of the breaker 1, it is possible to accurately position the breaker 1 without being affected by the enlargement of the first protrusion 74.

As shown in FIG. 5, the case 7 further has a second protrusion 76 protruding from the first protrusion 74 inwardly of the case 7 in planar view. By the second protrusion 76, the rigidity and strength of the first protrusion 74 and thus the case 7 are increased. The second protrusion 76 engages with the peripheral portion of the outer surface 81. A fitting portion having a U-shaped cross section is formed by the end face 72, the first protrusion 74 and the second protrusion 76 so as to surround the end edge 82 of the cover piece 8, and the cover piece 8 is fitted thereto. Thereby, the joining strength of the case 7 and the cover piece 8 can be further enhanced.

The tip end portion 74*a* of the first protrusion 74 protrudes upward away from the end face 72 than the second protrusion 76. Short-circuiting between the cover piece 8 and the fixed piece 2 and/or the terminal piece 3 is suppressed by such a first protrusion 74 more effectively.

The first protrusion 74 is continuously formed seamlessly over the whole circumference of the cover piece 8. In addition, it is desirable that the amount of protruding of the first protrusion 74 from the end face 72 is uniformly formed over the whole circumference of the cover piece 8. Thereby, the joining strength of the case 7 and the cover piece 8 can be further enhanced. In addition, the airtightness between the case 7 and the cover piece 8 is enhanced, so that intrusion of moisture vapor and the like from the exterior of the breaker 1 into the containing recess 73 and so on can be effectively suppressed.

Furthermore, in the present embodiment, the second protrusion 76 is continuously formed seamlessly over the whole circumference of the cover piece 8. Thereby, the joining strength of the case 7 and the cover piece 8 can be further enhanced. In addition, the airtightness between the case 7 and the cover piece 8 is enhanced, so that intrusion of moisture vapor and the like from the exterior of the breaker 1 into the containing recess 73 and so on can be effectively suppressed.

It is desirable that the cover piece 8 is made of a material having a higher elastic coefficient than that of the movable piece 4. Such a configuration can be easily realized, for example, when the movable piece 4 is composed of a metal plate containing copper or the like as a main component and the cover piece 8 is composed of a metal plate such as stainless steel. Consequently, the case 7 can be effectively reinforced while downsizing the breaker 1.

Hereinafter, a method of manufacturing the breaker 1 will be described. The method of manufacturing the breaker 1 includes a first step to a fourth step.

In the first step, as shown in FIG. 1, the PTC thermistor 6, the thermally responsive element 5 and the movable piece 4 are contained sequentially in the containing recess 73 of the case 7 in which the fixed piece 2 and the terminal piece 3 are insert molded in advance. Then, the movable piece 4 is joined to the terminal piece 3 by welding.

Figure 6:
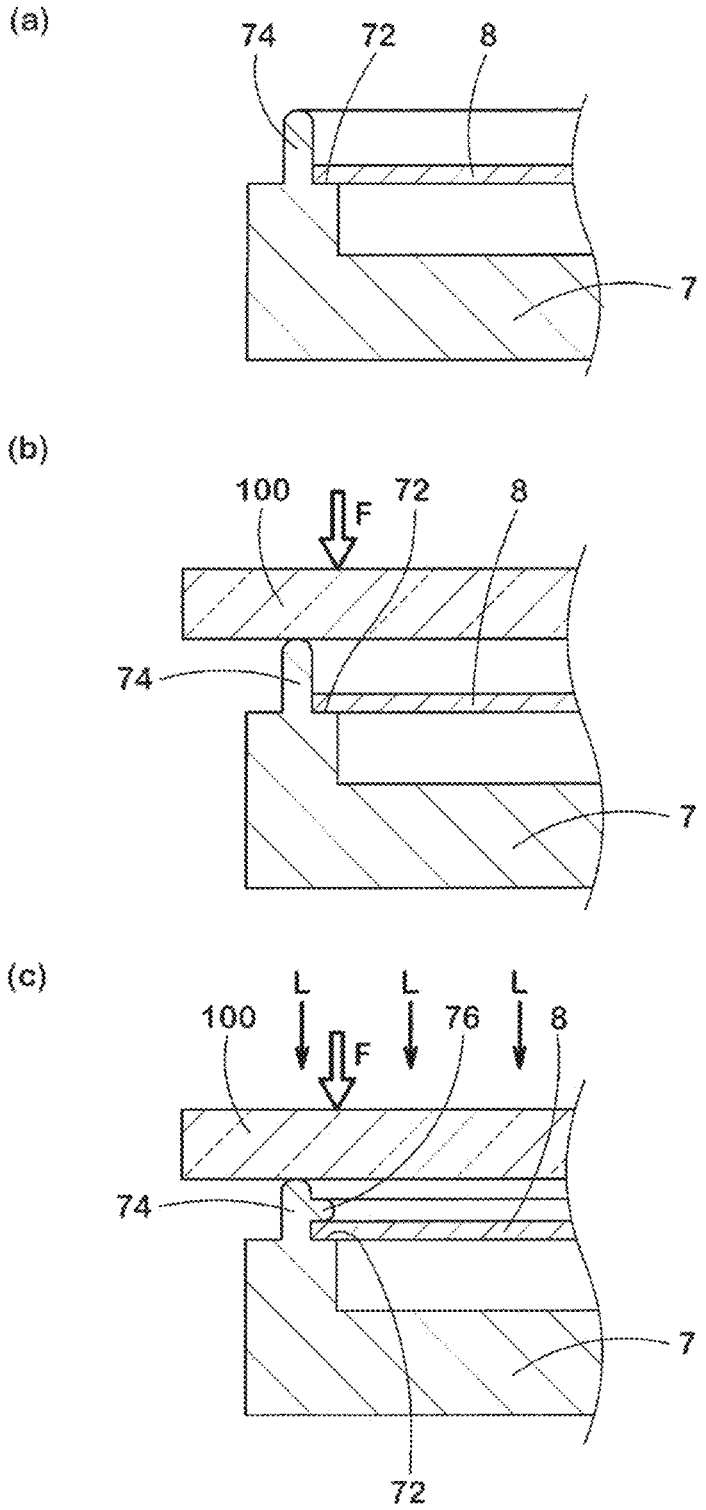
FIG. 6 is a cross-sectional view showing manufacturing processes of a breaker having the housing of electronic device.

FIG. 6 shows the second step to the fourth step. As shown in FIG. 6(*a*), in the second step, the cover piece 8 is attached to the end face 72 of the case 7. Thereby, the end edge 82 of the cover piece 8 is fitted to the first protrusion 74.

As shown in FIG. 6(*b*), in the third step, a pressing means 100 is placed on the first protrusion 74, and the first protrusion 74 is pressed by the pressing means 100 with a force F toward the end face 72. The pressing means 100 is made of, for example, a material such as a glass plate which transmits laser beams. The area to be pressed by the pressing means 100 is desirably the whole circumference of the first protrusion 74, but it may be a part of the first protrusion 74.

As shown in FIG. 6(*c*), in the fourth step, the first protrusion 74 and the cover piece 8 are heated. In this fourth step, the force F in the third step is maintained. In the present embodiment, the first protrusion 74 and the cover piece 8 are heated by irradiating the first protrusion 74 and the cover piece 8 with the laser beams L. The heating means is not limited to the irradiation with the laser beams L. For example, heating by blowing hot air, heating by irradiation with infrared rays, or heating by heat transfer from the pressing means 100 or the like may be used. In addition, a high voltage may be applied to the cover piece 8 so as to heat the cover piece 8 by using the Joule heat. Although the area to be heated is desirably the whole circumference of the first protrusion 74 and the cover piece 8 in the vicinity thereof, it may be a part of the first protrusion 74 and the cover piece 8 in the vicinity thereof.

In the fourth step, a laser projection device (not shown) for projecting the laser beams L is used. The temperature rise is promoted at the inner portion of the first protrusion 74 that is in contact with the cover piece 8 made of a metal by irradiation of the laser beams L, and the resin at the inner portion of the first protrusion 74 is melted faster than the resin at the outer portion. At this time, since the first protrusion 74 is pressed by the force F by the pressing means 100, the molten resin moves inward to ride on the cover piece 8, and thus, the second protrusion 76 is formed. Then, the end face 72, the first protrusion 74 and the second protrusion 76 surround the end edge 82 of the cover piece 8 and a region in the vicinity thereof and come into close contact. It is desirable that the amount of protrusion of the second protrusion 76 from the first protrusion 74 is uniform over the whole circumference of the cover piece 8. Such a second protrusion 76 is realized by heating the first protrusion 74 and the cover piece 8 so that the resin of the inner portion of the first protrusion 74 is melted uniformly over the whole circumference of the cover piece 8. For example, in order to continuously and uniformly form the second protrusion 76 over the whole circumference of the cover piece 8 seamlessly, it is desirable that the laser beams L are irradiated in the irradiation area of the first protrusion 74 and the cover piece 8 simultaneously without scanning.

By the way, in the case where the first protrusion 74 is directly irradiated with the laser beams L to uniformly heat the entire first protrusion 74 so as to melt the resin, since the heatability is varied corresponding to the transmittance and the absorptance of the resin with respect to the laser beams L, it is necessary to select a resin considering those. However, in the present embodiment, as described above, since the first protrusion 74 is heated by heat transfer from the cover piece 8, a resin that satisfies the melting point and the heat deflection temperature under load described above can be widely applied regardless of the transmittance or the absorptance with respect to the laser beams L.

Additionally, in the case of heating the entire first protrusion 74, when the molten resin runs over the cover piece 8 to form the second protrusion 76, if the first protrusion 74 enlarges outward of the case 7 than the outside surface 75 owing to the resin is similarly deformed so as to protrude to the outside of the first protrusion 74, it may affect the positioning accuracy of the breaker. However, in the present embodiment, the resin in the inner region of the first protrusion 74 is melted faster than the resin in the outer region, it is possible to form the second protrusion 76 while suppressing the deformation of the outer region of the first protrusion 74. In this regard, the present embodiment does not exclude an aspect in which the laser beams L are irradiated to the cover piece 8 as well as the entirety first protrusion 74.

In forming the second protrusion 76 from the first protrusion 74 to the inside of the case 7, the irradiation area of the laser beams L may be at least either the first protrusion 74 or the cover piece 8. Furthermore, the amount of protrusion of the second protrusion 76 from the first protrusion 74 can be adjusted by the irradiation intensity, the irradiation time and so on of the laser beams L.

As shown in FIGS. 6(*b*) and 6(*c*), the amount of protrusion of the first protrusion 74 from the end face 72 decreases following to protrusion of the second protrusion 76 in the fourth step. Therefore, the amount of protrusion of the first protrusion 74 from the end face 72 before the third step should be determined in consideration of the protrusion of the second protrusion 76 in the fourth step. In addition, it is desirable that the amount of protrusion of the first protrusion 74 from the end face 72 is uniform over the whole circumference of the cover piece 8 before and after the third step. Besides, the third step may be performed simultaneously with the fourth step or parallel to the fourth step after starting the fourth step.

The second protrusion 76 may be formed on the first protrusion 74 in advance before the cover piece 8 is attached to the end face 72 of the case 7 in the second step. For example, when forming the case 7, the second protrusion 76 may be formed in the first protrusion 74. In such a case, the third step and the fourth step may be omitted. In the present embodiment, by performing the third step and the fourth step, the amount of protrusion of the second protrusion 76 is sufficiently secured, and the joining strength and the airtightness of the case 7 and the cover piece 8 are enhanced.

Figure 7:
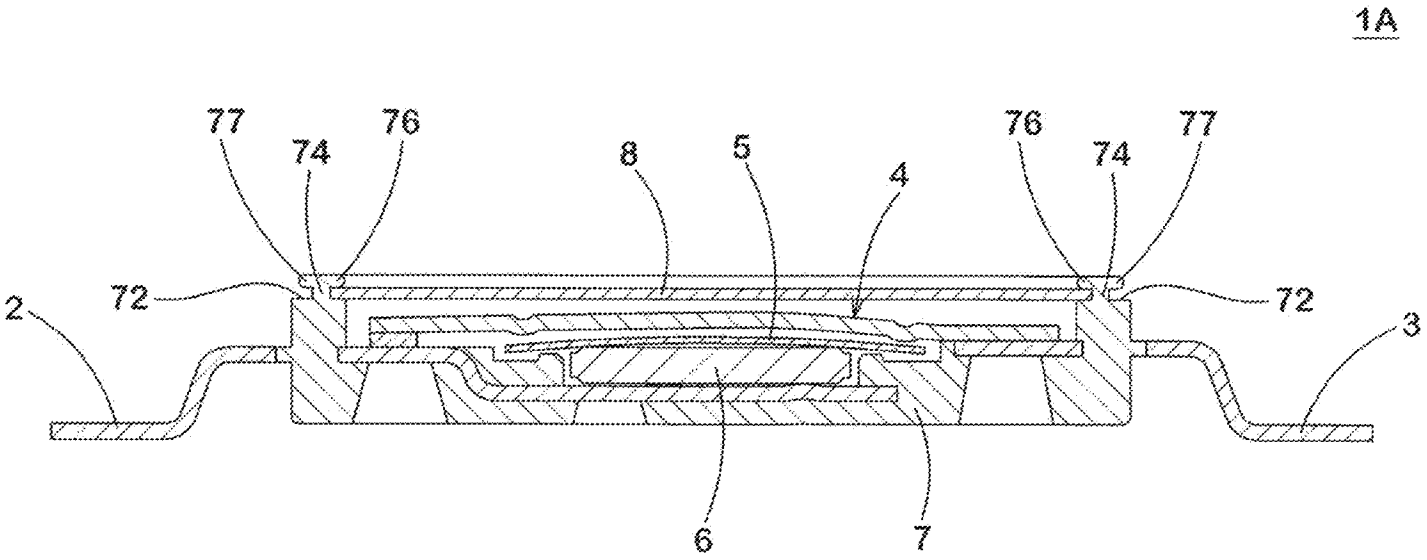
FIG. 7 is a cross-sectional view showing a configuration of a modified example of the breaker having the housing of electronic device.

FIG. 7 shows a breaker 1A which is a modification of the breaker 1. The breaker 1A is different from the breaker 1 in that the case 7 further has a third protrusion 77. With respect to the portions of the breaker 1A which are not described below, the configuration of the breaker 1 described above can be arbitrarily employed.

The third protrusion 77 protrudes from the first protrusion 74 outward of the case 7, that is, toward the side opposite to the second protrusion 76, in planar view. By the third protrusion 77, the rigidity and strength of the first protrusion 74 can be further enhanced. It is desirable that the third protrusion 77 be continuously and uniformly formed seamlessly over the whole circumference of the cover piece 8.

The third protrusion 77 shown in FIG. 7 can be formed by adjusting the irradiation intensity, the irradiation time and so on of the laser beams L in the fourth step.

The present invention is not limited to the configurations of the above embodiments, and in a breaker 1 or the like, which comprises at least a fixed contact 21, a movable piece 4 having a movable contact 41 and pressing the movable contact 41 to the fixed contact 21 to be contacted with it, a thermally responsive element 5 for operating the movable piece 4 so that the movable contact 41 is separated from the fixed contact 21 by deformation following to the temperature change, a case 7 for containing the fixed contact 21, the movable piece 4 and the thermally responsive element 5, and a cover piece 8 to be attached to the case 7, the case 7 may have an end face 72 on which the cover piece 8 is disposed, a containing recess 73 which is caved from the end face 72 and forms a space into which the movable piece 4 and the thermally responsive element 5 are contained, and a first protrusion 74 protruding from the end face 72 and fitted to the cover piece 8.

In addition, the movable piece 4 may be formed integrally with the thermally responsive element 5, by forming the movable piece 4 of a laminated metal such as bimetal or trimetal. In such a case, the configuration of the breaker is simplified, and downsizing can be achieved.

Furthermore, the shape of the cover piece 8 is not limited to a rectangle, and it may be a shape including a curve such as a circle or an ellipse. In such a case, the shape of the first protrusion 74 and so on is also changed corresponding to the cover piece 8. Still furthermore, the cover piece 8 may be configured to be joined to the first protrusion 74 at a part of the end edge 82. In such a case, the second protrusion 76 and so on are partially formed.

In the present embodiment, a self-holding circuit by the PTC thermistor 6 is provided, but it is applicable even in a mode in which such a configuration is omitted, and thus, the breaker 1 or the like can be downsized much more without impairing the rigidity and strength of the case 7.

The material constituting the cover piece 8 is not limited to metal. For example, the cover piece 8 may be made of a thermoplastic resin having a lower absorptance of laser beams or a higher melting point than the resin constituting the case 7.

Still furthermore, the shapes of the fixed piece 2, the terminal piece 3, the movable piece 4, the thermally responsive element 5, the PTC thermistor 6, the case 7, the cover piece 8 and so on are not limited to those shown in FIG. 1 or the like, and it may be changeable case by case.

Still furthermore, the present invention is applicable to a configuration in which the movable piece 4 is joined to the cover piece 8 as shown in each drawing of JP 2014-235913A. In such a case, the terminal piece 3 is unnecessary, and a terminal may be formed on the outer surface 81 of the cover piece 8.

Figure 8:
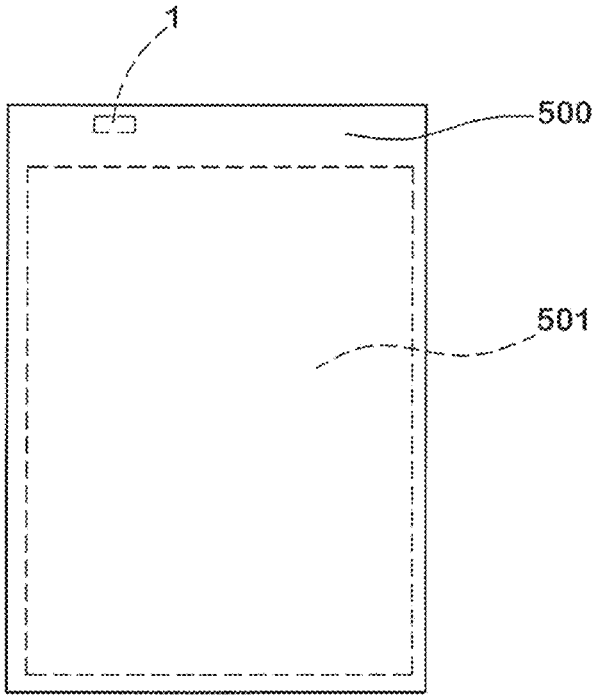
FIG. 8 is a plan view showing a configuration of a secondary battery pack having the breaker of the present invention.
Figure 9:
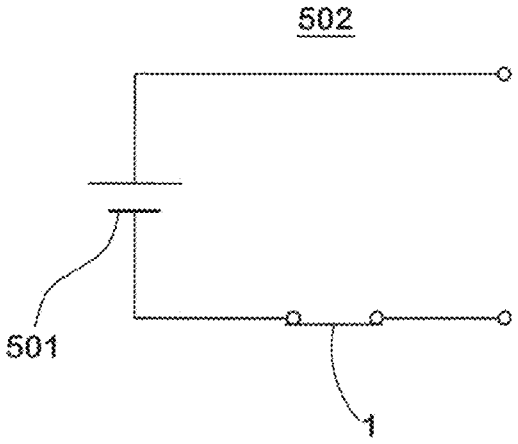
FIG. 9 is a circuit diagram of a safety circuit including the breaker of the present invention.

Still furthermore, the breaker 1 of the present invention is widely applicable to a secondary battery pack, a safety circuit for electric equipment, and the like. FIG. 8 shows a secondary battery pack 500. The secondary battery pack 500 comprises a secondary battery 501 and a breaker 1 provided in a circuit if an output terminal of the secondary battery 501. FIG. 9 shows a safety circuit 502 for the electric equipment. The safety circuit 502 includes a breaker 1 in series in the output circuit of the secondary battery 501. According to the secondary battery pack 500 or the safety circuit 502 provided with the breaker 1, it is possible to manufacture the secondary battery pack 500 or the safety circuit 502 that can secure a good current interruption operation.

Figure 10:
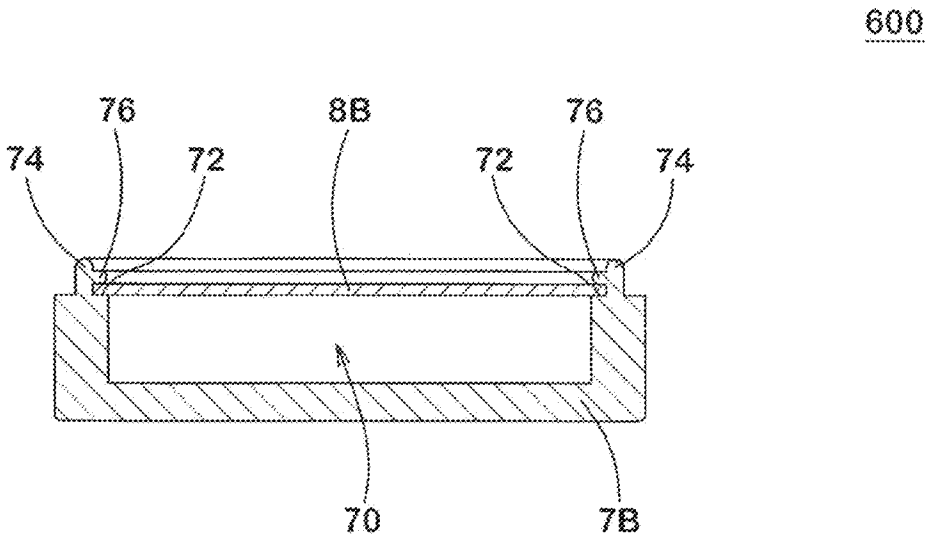
FIG. 10 is a cross-sectional view showing a configuration of a resin molded body having a case and a cover piece equivalent to the housing of electronic device.

FIG. 10 shows an embodiment of a resin molded body 600 having an equivalent structure as the case 7 and the cover piece 8 of the breaker 1 of the present invention. With respect to the portions of the resin molded body 600 not described below, the structure of the breaker 1 described above is arbitrarily employed, and equivalent effects can be obtained.

The resin molded body 600 comprises a case 7B having a space 70 therein and a cover piece 8B attached to the case 7B.

The case 7B is made of a thermoplastic resin. The cover piece 8B is desirably made of metal. In the case where the case 7B and the cover piece 8B are joined in the steps equivalent to the steps shown in FIG. 6, the cover piece 8B may be formed of a thermoplastic resin having a lower absorptance of the laser beams or having a higher melting point than that of the resin forming the case 7B.

The cases 7A and 7B are not limited to thermoplastic resins and may be formed of a thermosetting resin. In such a case, if the first protrusion 74 is heated to the vicinity of the glass-transition point and softened in the fourth step, the similar joining strength and airtightness as those of the thermoplastic resin can be obtained. The thermoplastic resin is not limited to those shown in the embodiments, and it is possible to alleviate restrictions of the embodiments such as heat deflection temperature under load and melting point depending on the wave number, the irradiation strength, the transmittance, the absorptivity or the like of the laser beams L or depending on the joining strength of the required case 7 and the cover piece 8, or the like, responding to usage conditions of the housing.

In addition to the housing of the breaker 1, the resin molded body 600 can also be applied to a housing of various elements such as a connector, a relay, a switch, or the like. Furthermore, the case 7B of the resin molded body 600 is not limited to the configuration in which the space 70 is provided therein, and it is possible to apply a configuration in which no space 70 is provided when the housing is completed by installing the cover piece 8. Still furthermore, the cover piece 8B is not limited to a planar shape.

In addition to the breaker mentioned above, as a configuration of the electronic element contained in the case 7, various things are envisaged such as one having a flat shape and spreading or printing is performed in the containing recess of the case, or one which is molded with, embedded within, adhered on, fitted to, or the like, in advance as a part of the case. A time point at which the electronic elements are contained is not limited to the time before the cover piece 8 is installed on the case 7, it is possible simultaneously with completion of the housing or after completion of the housing ex-post facto.

The aspect of the case 7 is not limited to one in which the cover piece 8 is fitted to over the whole circumference of the case 7 as described above, it may be configured that a section in which the first protrusion 74 is not provided on a part of the outside faces 75 of the case 7. In addition, it is not essential to seal all of the openings 73*a*, 73*b* and 73*c* of the case 7. It is possible to be configured that a part or the whole of the upper surface, a part or the whole of the bottom surface, or a part of the side surface of the case 7 may be opened.

Figure 11:
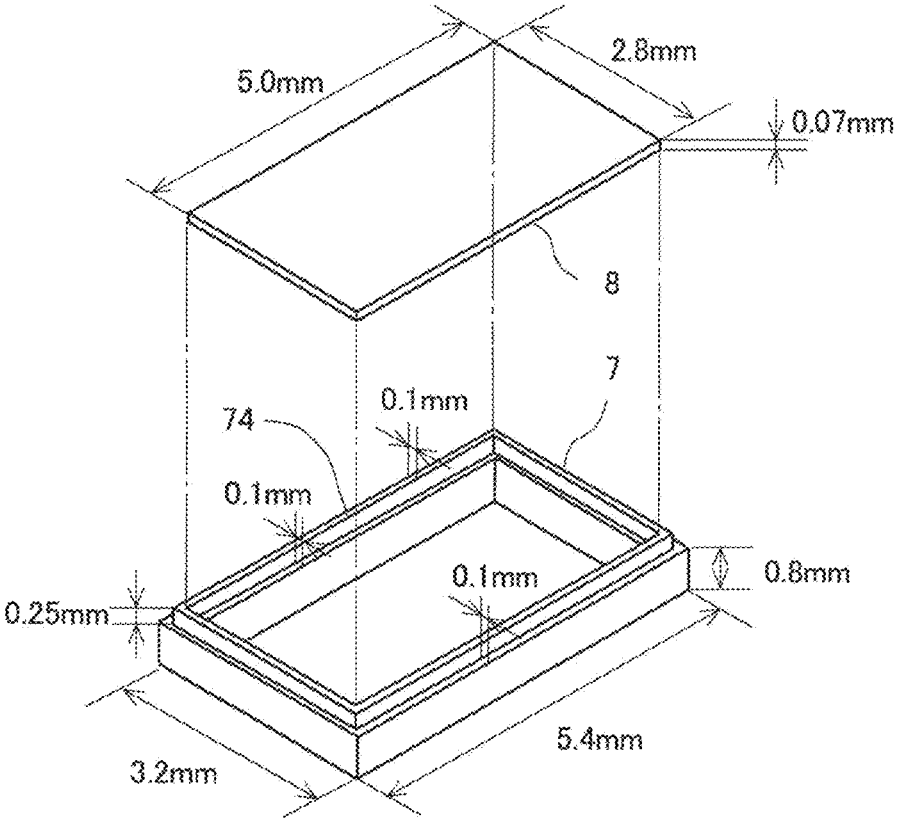
FIG. 11 is a view showing the shapes and dimensions of the case and the cover piece of prototype.
Figure 12:
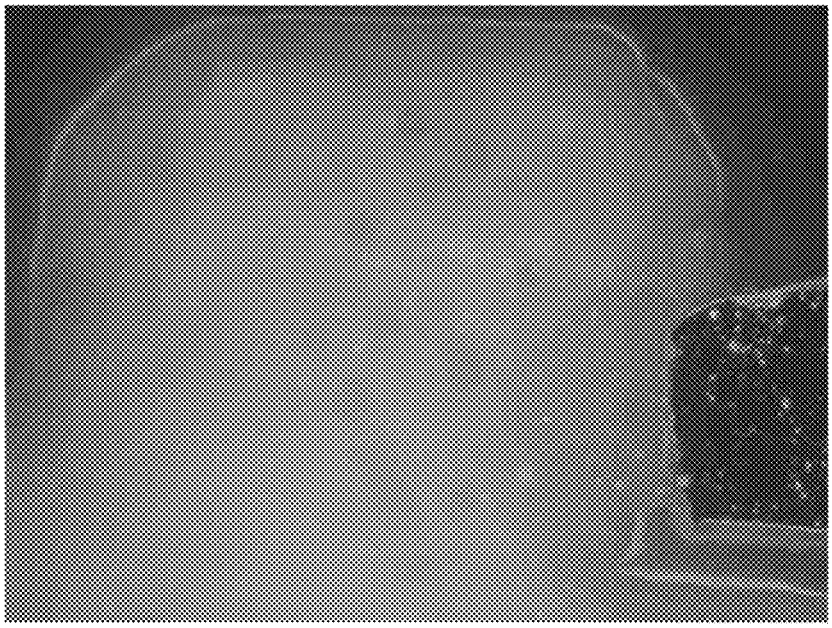
FIG. 12 is a photograph showing a state of fixing the cover piece when a first protrusion is deformed by irradiating laser beams to a case according to Embodiment 1.
Figure 13:
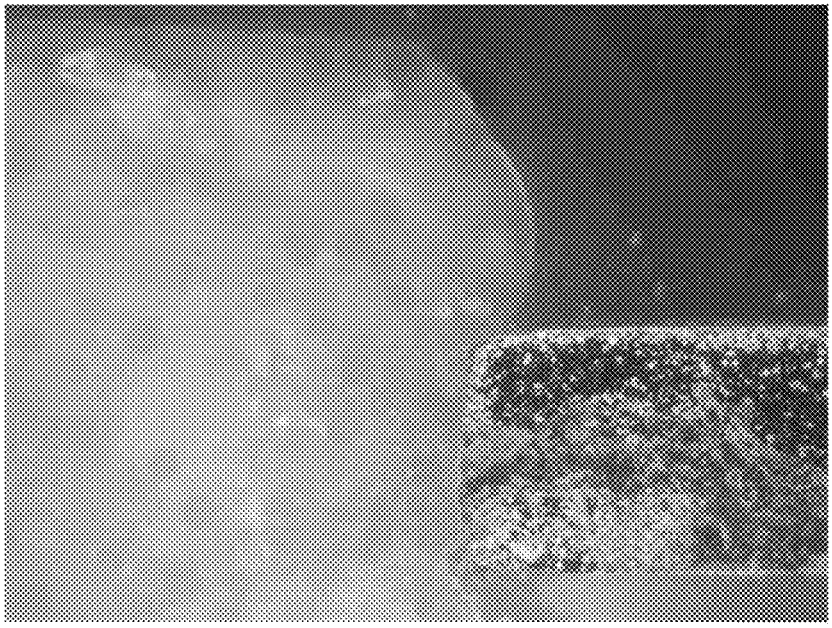
FIG. 13 is a photograph showing a state of fixing the cover piece when a first protrusion is deformed by irradiating laser beams to a case according to Embodiment 2.
Figure 14:
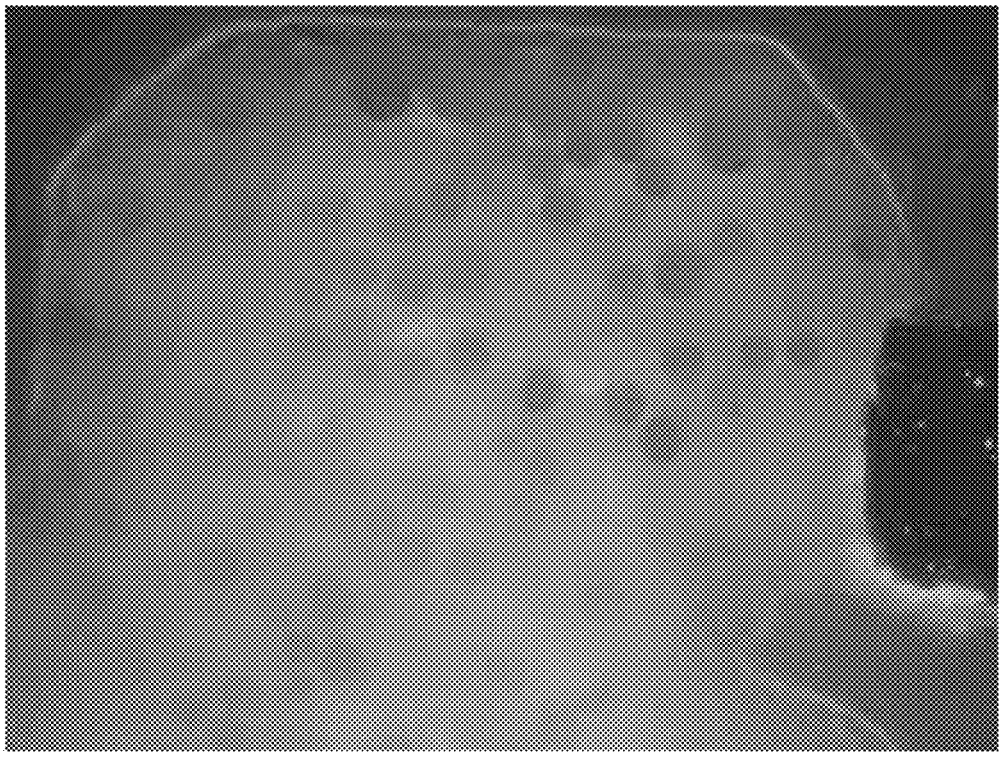
FIG. 14 is a photograph showing a state of fixing the cover piece when a first protrusion is deformed by irradiating laser beams to a case according to Embodiment 3.
Figure 15:
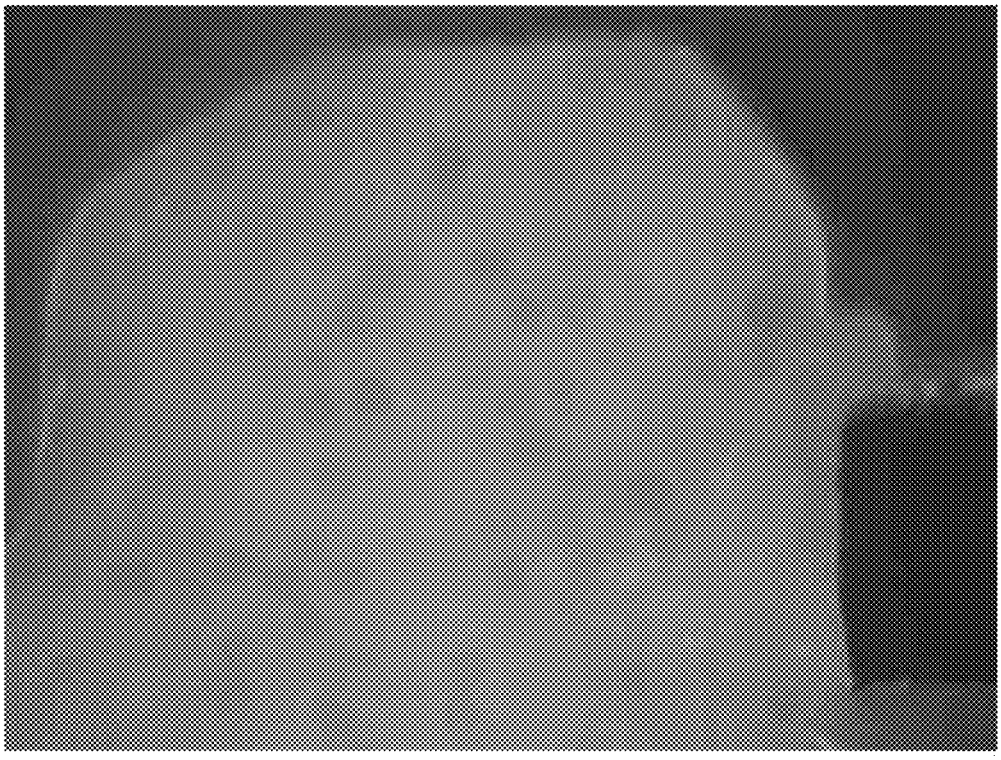
FIG. 15 is a photograph showing a state of fixing the cover piece when a first protrusion is deformed by irradiating laser beams to a case according to Embodiment 4.

A case 7 shown in FIG. 11 was prototyped using a plurality of kinds of resin materials, a cover piece 8 made of stainless steel was fitted to the prototype case 7, and laser beams were irradiated to deform a first protrusion 74, and the state of fixing the cover piece 8 was observed. The results will be described below.

Example 1

Resin Composition 1: A resin composition which was obtained by adding 10% by mass of glass fiber having a length of 70 μm and a thickness of 10 μm and 30% by mass of talc into a liquid crystal polymer having a melting point of 355 degrees Celsius (melting point 355 degrees Celsius, heat deflection temperature under load 235 degrees Celsius, a difference between the melting point and the heat deflection temperature under load 120 degrees Celsius).

Example 2

Resin Composition 2: A resin composition which was obtained by adding 40% by mass of glass fiber having a length of 70 μm and a thickness of 10 μm into a liquid crystal polymer having a melting point of 355 degrees Celsius (melting point 355 degrees Celsius, heat deflection temperature under load 250 degrees Celsius, a difference between the melting point and the heat deflection temperature under load 105 degrees Celsius).

Example 3

Resin Composition 3: A resin composition which was obtained by adding 40% by mass of glass fiber having a length of 3 mm and a thickness of 10 μm into a liquid crystal polymer having a melting point of 355 degrees Celsius (melting point 355 degrees Celsius, heat deflection temperature under load 280 degrees Celsius, a difference between the melting point and the heat deflection temperature under load 70 degrees Celsius).

Example 4

Resin composition 4: A resin composition which was obtained by adding 40% by mass of glass fiber having a length of 70 μm and a thickness of 10 μm into a liquid crystal polymer having a melting point of 350 degrees Celsius (melting point 350 degrees Celsius, heat deflection temperature under load 310 degrees Celsius, a difference between the melting point and the heat deflection temperature under load 40 degrees Celsius).

Comparative Example 1

Resin Composition 5: A resin composition which was obtained by adding 35% by mass of glass fiber having a length of 3 mm and a thickness of 10 μm into a liquid crystal polymer having a melting point of 350 degrees Celsius (melting point 350 degrees Celsius, heat deflection temperature under load 340 degrees Celsius, a difference between the melting point and the heat deflection temperature under load 10 degrees Celsius).

FIG. 11 shows the shapes and dimensions each part of the case 7 obtained by injection-molding the above resin compositions and the cover piece 8. This case 7 was a substantially rectangular parallelepiped box having an opening on a top surface with sizes of 5.4 mm in length×3.2 mm in width×0.8 mm in height, with a bottom surface thickness of 0.2 mm, a side wall thickness of 0.3 mm, and a rectangular first protrusion 74 having a height of 0.25 mm and a thickness of 0.1 mm was formed over the whole circumference of the top portion of the side walls. The cover piece 8 made of stainless steel having sizes of 5.0 mm in length×2.8 mm in width×0.07 mm in thickness was fitted to the inner circumferential side of the first protrusion 74 of the case 7, and a region from the cover piece 8 to the first protrusion 74 were heated by irradiation of laser beams for one second at an output of 35 W with using the LD-HEATER L10060 manufactured by Hamamatsu Photonics K.K., after fixing the cover piece 8 by deformation of the first protrusion 74 of the case 7, it was embedded with an epoxy resin and cut at a substantially central portion in the longitudinal direction, and the deformed state of the first protrusion 74 and the fixed state of the cover piece 8 by the first protrusion 74 were observed. The results are shown in FIGS. 12 to 17.

Figure 16:
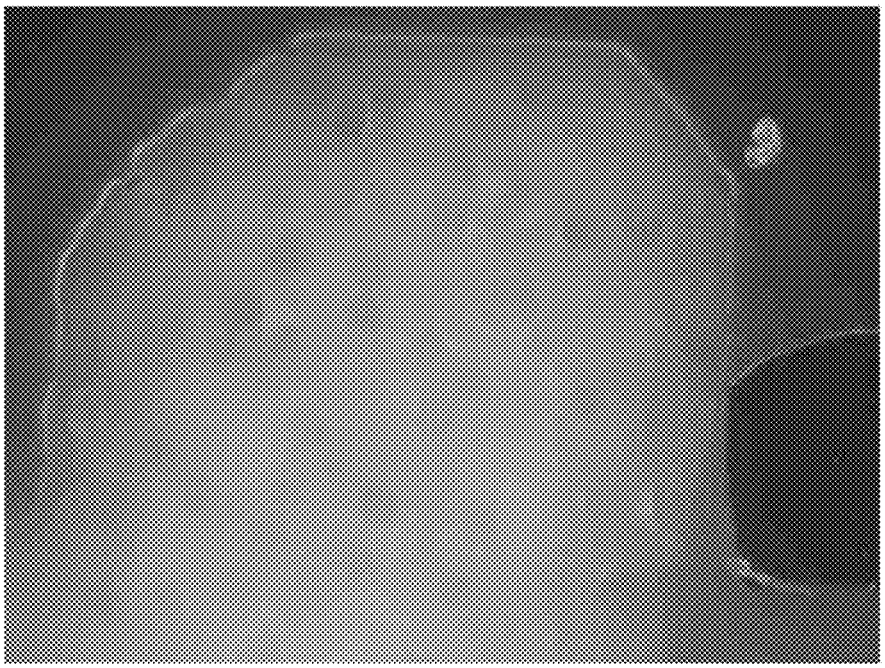
FIG. 16 is a photograph showing a state of fixing the cover piece when a first protrusion is deformed by irradiating laser beams to a case according to Comparative Example 1.
Figure 17:
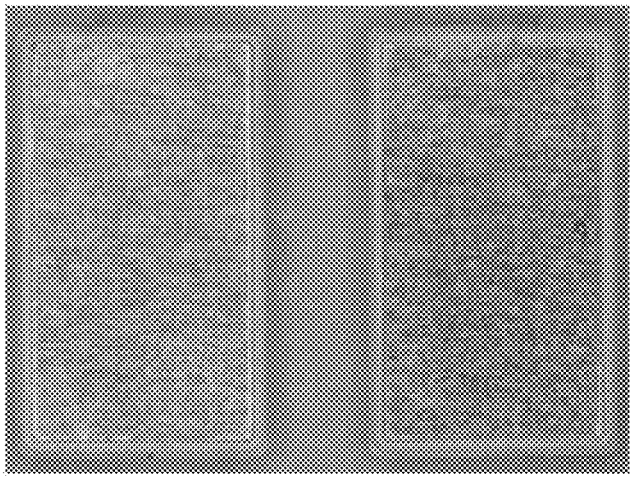
FIG. 17 is a comparative photograph showing that the cover piece could not be fixed even if raising the output of the laser beam until the cover piece discolored by heat, for the case according to Comparative Example 1.

As shown in FIGS. 12 to 15, with respect to the resin compositions 1 to 4 in Examples 1 to 4, the larger the difference between the melting point and the heat deflection temperature under load, the greater the deformation of the first protrusion 74, so that it was confirmed that the cover piece 8 was sufficiently fixed. On the other hand, as shown in FIG. 16, when the difference between the melting point and the heat deflection temperature under load is small like the resin composition 5 in Comparative Example 1, the first protrusion 74 was deformed insufficiently, and thus, the cover piece 8 was not fixed. Hereupon, with respect to the resin composition 5 in Comparative Example 1, the laser beams were irradiated for one second with raising the output to 40 W, and as shown on the right side of FIG. 17, the cover piece 8 was not fixed although it was heated under conditions sufficient to discolor the cover piece 8 with heat. Besides, the left side of FIG. 17 shows the cover piece 8 when laser beams were irradiated for one second at an output of 35 W for comparison.

Figure 18:
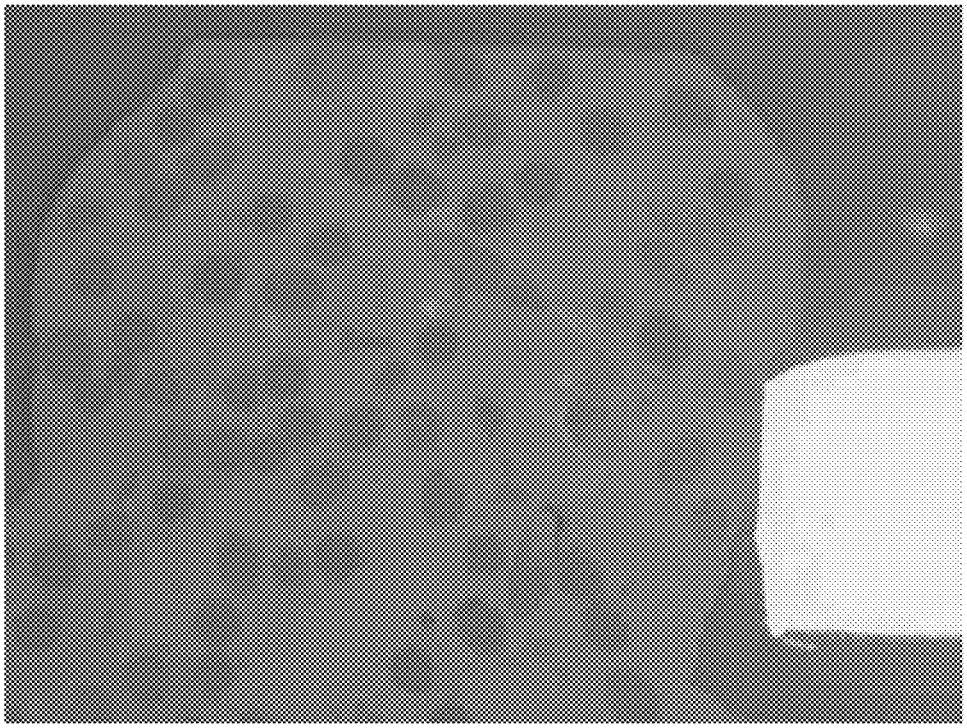
FIG. 18 is a photograph showing a state of fixing the cover piece when a first protrusion is deformed by irradiating laser beams to a case according to Embodiment 5.

Incidentally, using a case obtained by injection molding of a resin composition 6 which was obtained by adding 40% by mass of glass fiber having a length of 70 μm and a thickness of 10 μm and 1% by mass of carbon black into a liquid crystal polymer having a melting point of 350 degrees Celsius (melting point 350 degrees Celsius, heat deflection temperature under load 310 degrees Celsius, a difference between the melting point and the heat deflection temperature under load 40 degrees Celsius), irradiating the laser beams to the cover piece 8 and the first protrusion 74 for one second at an output of 30 W, the fixed state of the cover piece 8 by the first protrusion 74 was observed, similar to as above. The result is shown in FIG. 18 as Example 5. In comparison with the uncolored resin composition 4 (FIG. 15), despite the fact that the melting point and the heat deflection temperature under load were the same, it was confirmed that the deformation of the first protrusion 74 was large and the cover piece 8 was more firmly joined. The crimping state can be remarkably improved by the coloring agent which absorbs the laser beams until the deformation of the first protrusion 74 of Example 4 is changed to the same degree as that of Example 2. As seen in this Example 5, by adjusting the absorptivity for the laser beams of the resin composition to be deformed, it is possible to alleviate the conditions of the temperature characteristics such as the melting point and heat deflection temperature under load.

REFERENCE SIGNS LIST

1 Breaker
3 Terminal piece
4 Movable piece
5 Thermal responsive element
7 Case
8 Cover piece
21 Fixed contact
41 Movable contact
72 End face
73 Containing recess
74 First protrusion
75 Outer side
76 Second protrusion
77 Third protrusion
501 Secondary battery
502 Safety circuit

The invention claimed is:

1. An electronic device comprising a case for containing electronic elements therein and a cover piece attached to the case, wherein the case has an end face on which the cover piece is disposed, a containing recess which is caved from the end face and serves as a space into which the electronic elements are contained, and a first protrusion which is protruded from the end face and to which the cover piece is fitted, and the case is formed of a thermoplastic resin composition having a heat deflection temperature under load in a range equal to or higher than 120 degrees Celsius and equal to or lower than 320 degrees Celsius, and a temperature difference between a melting point and the heat deflection temperature under load is equal to or larger than 15 degrees Celsius wherein the cover piece has an outer surface exposed from the case and the first protrusion is formed to protrude from the outer surface, and the case has a second protrusion protruding from the first protrusion toward the inside of the case and engaging with the outer surface.

2. The housing of electronic device housing according to claim 1, wherein the case has outer lateral faces intersecting with the end face or an extension of the end face, and the first protrusion is disposed closer to the containing recess than the outer lateral faces.

3. The housing of electronic device housing according to claim 1, wherein a tip end of the first protrusion is protruded further away from the end face than the second protrusion.

4. The electronic device housing according to claim 1, wherein the first protrusion is continuously formed seamlessly over whole circumference of the cover piece.

5. The electronic device housing according to claim 4, wherein the second protrusion is continuously formed seamlessly over whole circumference of the cover piece.

6. The electronic device housing according to claim 1, wherein the case further has a third protrusion protruding from the first protrusion toward the outside of the case.

7. A method for manufacturing the electronic device housing according to claim 1 including:

a first step for containing at least the electronic elements into the containing recess;

a second step for attaching the cover piece to the end face;

a third step for pressing the first protrusion toward the end face; and a fourth step for deforming the first protrusion by heating at least one of the first protrusion and the cover piece.

8. A breaker characterized by a fixed piece having a fixed contact, a movable piece having a movable contact and pressing and contacting the movable contact to the fixed contact, and a thermally responsive element for moving the movable piece to separate the movable contact from the fixed contact by deformation in response to a temperature change are contained in the electronic device housing according to claim 1 as the electronic elements.

* * * * *